US005384060A

United States Patent [19]

Mandy et al.

[11] Patent Number: 5,384,060

[45] Date of Patent: Jan. 24, 1995

[54] SOLID LAUNDRY PRE-SPOTTER COMPOSITION CONTAINING ENCAPSULATED SODIUM BICARBONATE AND METHOD OF USE

[75] Inventors: John C. Mandy, Woodbridge; Michael D. Fatigante, Dayton, both of N.J.

[73] Assignee: Fluid Packaging Company Inc., Lakewood, N.J.

[21] Appl. No.: 198,806

[22] Filed: Feb. 18, 1994

Related U.S. Application Data

[63] Continuation-in-part of Ser. No. 912,191, Jul. 13, 1992, Pat. No. 5,288,421.

[51] Int. Cl.[6] ..... C11D 3/10; C11D 17/00; C11D 17/08; D06L 1/16

[52] U.S. Cl. ..... 252/92; 8/137; 252/90; 252/121; 252/122; 252/125; 252/130; 252/134; 252/174; 252/174.12; 252/174.13; 252/174.14; 252/174.21; 252/174.23; 252/559

[58] Field of Search ..... 252/90, 92, 121, 122, 252/125, 130, 134, 174, 174.12, 174.13, 174.14, 174.21, 174.23, 559

[56] References Cited

U.S. PATENT DOCUMENTS

| | | | |
|---|---|---|---|
| 3,761,415 | 9/1973 | Gould | 252/174.14 |
| 3,953,353 | 4/1976 | Barrett | 252/174 |
| 3,997,459 | 12/1976 | Bogie | 252/99 |
| 4,210,550 | 7/1980 | Cornelissens | 252/90 |
| 4,289,644 | 9/1981 | Stainhauser et al. | 252/127 |
| 4,636,328 | 1/1987 | Flynn et al. | 252/90 |
| 4,842,762 | 6/1989 | Sabol, Jr. et al. | 252/109 |
| 5,288,420 | 2/1994 | Mandy | 252/121 |
| 5,288,421 | 2/1994 | Mandy | 252/121 |

FOREIGN PATENT DOCUMENTS

| | | | |
|---|---|---|---|
| 2098760 | 12/1993 | Canada | C11D 9/26 |
| 2098761 | 1/1994 | Canada | C11D 9/26 |

*Primary Examiner*—Dennis Albrecht

*Attorney, Agent, or Firm*—Fitzpatrick, Cella, Harper & Scinto

[57] ABSTRACT

A stearate-matrix, pre-spotter composition in solid stick form to be applied by direct contact to stained areas of fabric, thereby transferring the composition to the stained areas of the fabric. The composition includes an alkyl aromatic sulfonic acid and/or sulfonate, at least one nonionic surfactant, and an enzyme uniformly dispersed throughout a semi-hard stearate matrix. By the addition of sodium bicarbonate, the composition optimizes the pH to promote enzyme action, while simultaneously achieving a satisfactory drop point for shipping and warehousing. At pH levels from 8.2 to 9.0, acceptable hardness and transferability are still achieved, which was previously thought not to be possible without the addition of a critical amount of certain salts. The further addition of sodium bicarbonate in an encapsulated form directs the sodium bicarbonate-driven soil and stain removing capabilities of the composition to the point of application on the fabric.

27 Claims, No Drawings

SOLID LAUNDRY PRE-SPOTTER COMPOSITION CONTAINING ENCAPSULATED SODIUM BICARBONATE AND METHOD OF USE

This application is continuation-in-part patent application from co-pending commonly assigned application Serial No. 07/912,191, filed July 13, 1992 now U.S. Pat. No. 5,288,421, issued Feb. 22, 1994.

BACKGROUND OF THE INVENTION

A. Field of the Invention

The present invention relates to a solid type fabric-cleaning product, whose utility is as a pre-applied spotting agent for use prior to laundering or dry cleaning to facilitate the removal of stains and soil from selected pre-treated areas of the fabric. More particularly, the invention is directed to a solid laundry pre-spotter composition that includes sodium stearate, propylene glycol, a polyethylene glycol, an alkyl aromatic acid, a strong base, non-ionic surfactants, sodium bicarbonate–both in its free form and in an encapsulated form, an enzyme and water.

B. Description of the Prior Art

Compositions have long been used as pre-spotting preparations in the laundering and cleaning field. Such preparations have been applied to particular, selected stained or excessively soiled portions of clothing and other fabrics prior to laundering. Effective pre-treatment of this type increases the likelihood of removing the soils and stains from the fabric during the cleaning process.

Some of the pre-spotting compositions have included laundry enzymes of the type that have been shown to enhance the removal of foreign material, such as oil stains, other stains, and soil from fabrics. When enzyme systems are used, they are critically sensitive to the pH of the composition into which they are introduced.

Prior art "stain sticks" or pre-spotting compositions have included those having a sodium stearate matrix. However, those skilled in the art have long tried, and yet failed, to formulate a product which is a firm solid having an acceptable drop point and also has a pH below about 9.8, yet yielding when manual pressure is applied, a value reasonably expected to be compatible with enzyme activity. As discussed extensively in Sabol et al., U.S. Pat. No. 4,842,762 issued Jun. 27, 1989, many of the stick-type products based on sodium stearate have failed to achieve a good working balance of physical properties, such as hardness and drop point, with desirable chemical properties, such as a pH that falls within a range that is acceptable for enzyme activity.

Sabol et al. recommends the formation of sodium stearate in situ and the addition of various salts to selectively modify particular physical and chemical parameters of the composition, including texture, consistency, hardness, melting point and pH, to optimize the rheology and the softening range of the product. In particular, Sabol et al. teaches that the addition of a certain class of salts within a critical concentration range of from 1 to 4% by weight is necessary to achieve good physical and chemical properties for this type of product.

In co-pending U.S. patent application Ser. No. 07/901,785 filed on Jun. 22, 1992 by Mandy, entitled SOLID LAUNDRY PRE-SPOTTER COMPOSITION AND METHOD OF USE, now U.S. Pat. No. 5,288,420, issued Feb. 22, 1994 a solid laundry pre-spotter with optimum physical parameters was achieved, but without the necessity of adding a critical concentration of salt to a sodium stearate matrix composition. Simultaneously, the pH level was decreased to as low as 9.0, thereby enhancing enzyme activity while maintaining acceptable physical properties, such as hardness and drop point.

And in co-pending U.S. patent application Ser. No. 07/912,191 filed on Jul. 13, 1992 by Mandy, SOLID LAUNDRY PRE-SPOTTER COMPOSITION CONTAINING SODIUM BICARBONATE AND METHOD OF USE, now U.S. Pat. No. 5,288,421, issued Feb. 22, 1994 from which the present application claims the benefit of an earlier filing date, solid laundry pre-spotter compositions are taught that use sodium bicarbonate to decrease the pH level to below 9.0, and as low as 8.2, thereby enhancing enzyme activity while maintaining acceptable physical properties, such as hardness and drop point.

With the advent of encapsulation technology, new packaging techniques and other considerations have surfaced when formulating compositions for solid consumer products. Heretofore, however, such technology has not been used in connection with solid laundry pre-spotter stick compositions, especially in terms of encapsulating a sodium bicarbonate ingredient.

SUMMARY OF THE INVENTION

The present invention is directed to solid laundry pre-spotter stick compositions that use encapsulated sodium bicarbonate, the use of which is believed to allow for more potent soil or stain removing capabilities at the area on the fabric where the soil or stain exists. The force involved in applying such a pre-spotter laundry stick composition to soiled or stained fabrics causes sodium bicarbonate to be released on contact. Such an event should lead to more effective soil or stain removal.

The addition of the further amount of sodium bicarbonate, in an encapsulated form, directs the soil and stain removing capabilities of the composition to the point of application on the fabric. Also the addition of an encapsulated sodium bicarbonate ingredient in a stearate pre-spotter composition can achieve pH levels below 9.0, thus further enhancing enzyme activity. This additional amount of sodium bicarbonate in encapsulated form provides adequate hardness and drop point at a pH level as low as 8.2, greatly facilitating enzyme activity and the effectiveness of stain removal while extending further the length of time that the stain remover can safely remain in contact with the soiled fabric. In addition, by concentrating the sodium bicarbonate-driven soil and stain removing capabilities of the pre-spotter composition to the point of application, the pre-spotter composition may be applied in smaller quantities to achieve satisfactory results.

Sodium bicarbonate operates as a detergent builder, which removes certain ionic materials commonly found in hard water that would otherwise lead to the precipitation of solid deposits during the laundering process. Also, the addition of certain amounts of sodium bicarbonate permits the use of a lower pH in a stain stick composition, while still maintaining the desired physical properties of the composition.

Now, the use of the additional encapsulated sodium bicarbonate ingredient in the laundry stick composition is believed to further enhance the above-mentioned properties. Specifically, the use of encapsulated sodium bicarbonate is believed to enhance the effectiveness of the laundry stick by directing a concentrated amount of the sodium bicarbonate onto the soiled or stained fabric.

One aspect of the present invention is a laundry soil and stain remover composition in applicator stick form for application to soiled or stained fabric as an aid in laundering, wherein the composition comprises:

A. from about 10 to about 15% by weight of sodium stearate;

B. from about 8 to about 11% by weight of propylene glycol;

C. from about 3 to about 6% by weight of a polyethylene glycol;

D. from about 10 to about 20% by weight of an alkyl aromatic sulfonic acid surfactant, an alkyl aromatic sulfonate surfactant that has been formed in situ by the reaction of said alkyl aromatic sulfonic acid with a strong base, or a mixture thereof;

E. from about 2 to about 6% by weight of a strong base capable of reacting in situ with said alkyl aromatic sulfonic acid surfactant to form a semi-solid sulfonate product;

F. from about 20 to about 35% by weight of at least one nonionic surfactant, wherein the nonionic surfactant is different from the alkyl aromatic sulfonic acid surfactant or the alkyl aromatic sulfonate surfactant above;

G. from about 2 to about 10% by weight of an enzyme;

H. from about 20 to about 30% by weight water;

I. an amount of sodium bicarbonate sufficient to reduce the pH of the composition to the range of about 8.2 to about 9.0; and J. an additional amount of sodium bicarbonate, where this additional amount of sodium bicarbonate is present in an encapsulated form. The resulting composition of the invention typically has a pH of between about 8.2 and about 9.0, a drop point of greater than about 115° F, and a penetrometer reading of at least about 55 units (5.5 mm). In addition, the encapsulated sodium bicarbonate directs a concentrated amount of the sodium bicarbonate-driven soil or stain removing capabilities of the composition to the point of the soil or stain on the fabric.

Another aspect of the invention involves a process for cleaning fabric that has soiled or stained portions, the process comprising the steps of:

a. applying to the soiled or stained portions of the fabric, prior to cleaning, the soil and stain remover composition of the invention, and b. cleaning the soiled or stained fabric to which said composition has been applied by laundering or dry cleaning.

The composition of the invention uses a stearate matrix and still achieves a pH below about 9.0, thereby enhancing the action of the enzyme in the composition. Simultaneously, an acceptably high drop point and hardness is maintained, and the transfer of the compound to the stained fabric is facilitated. This combination of physical and chemical characteristics is not frequently observed and is not customarily believed to be possible when working with stearate matrix formulations.

Specifically, if the pH in such formulations is controlled within the optimum range for enzyme action, the drop point and transferability are typically less than satisfactory for the intended end use. Unexpectedly, the addition of sodium bicarbonate in the present invention allows one to reduce the pH, even down to a range of 8.2 to 9.0, to further enhance enzyme action while simultaneously achieving a drop point in excess of 115° F., a superior transferability, and improved penetration of the stick composition into the stained fabric, as evidenced by a desirable waxy sheen on the stained portions to which the composition has been applied.

Now, by adding a further quantity of sodium bicarbonate, in an encapsulated form, the use and effectiveness of the solid laundry pre-spotter composition may be enhanced by directing a concentrated amount of the sodium bicarbonate-driven soil or stain removing capabilities of the composition to the point of the soil or stain on the fabric.

DETAILED DESCRIPTION OF THE INVENTION

The laundry soil and stain remover composition of the invention, which is in applicator stick form, comprises from about 10 to about 15% by weight of sodium stearate, preferably about 11%. Sodium stearate is used in a number of solid consumer products that are sold in applicator stick form because of the ability of sodium stearate to form a dense solid when combined with other liquid ingredients, such as propylene glycol and water. Further, under the conditions of the invention, it is believed that sodium stearate provides a firm but "yielding" matrix of about the right hardness or penetrability for use in the present invention.

The composition of the invention also includes propylene glycol as an organic solvent in the matrix system formed with sodium stearate. The amount of propylene glycol can vary from about 8 to about 11% by weight, preferably about 9%. This amount is significantly lower than the 35 to 40% of propylene glycol that is typically used in prior art formulations of solid, sodium stearate applicator sticks.

At least one polyethylene glycol is used for the composition as a softener. Useful amounts vary from about 3 to about 6% by weight and are preferably about 4%. This amount is significantly higher than the 1 to 2% by weight typically used in prior art formulations. Useful polyethylene glycols have a molecular weight of at least about 3,000, preferably between about 3,000 and about 20,000 and, most preferably, about 20,000. The melting point of useful polyethylene glycols should preferably be between about 129° F. to about 147° F. to provide a smooth melt as the composition is being prepared. In an especially preferred embodiment the polyethylene glycol is one sold by the Union Carbide Company under the trade name PEG 20000 TM (CTFA name, PEG 20M), which has the general formula:

$$H(OCH_2CH_2)_nOH$$

where n has an average value of 20,000.

An alkyl aromatic sulfonic acid, alkyl aromatic sulfonate, or a mixture thereof, is added to the composition. It is believed that this addition acts as an anionic surfactant, particularly when it taken in combination with a strong base, which is believed neutralizes at least a portion of any sulfonic acid present to form the corresponding sulfonate. Thus, it is believed that the alkyl aromatic sulfonic acid, alkyl aromatic sulfonate or mixture thereof helps to maintain all solvents and ingredients dissolved in a single aqueous phase. Useful alkyl aromatic sulfonic acids include linear alkyl benzenesulfonic acids, such as ethyl benzenesulfonic acid, ethylamino benzenesulfonic acid, toluene sulfonic acid, xylene sulfonic acid, and dodecyl benzenesulfonic acid; mixed linear and nonlinear alkyl benzenesulfonic acids, such as 2-isopropyl-5-omethyl benzenesulfonic acid; alkyl naphthalenesulfonic acids, such as methyl naphthalenesulfonic acid, ethyl naphthalenesulfonic acid, isopropyl naphthalenesulfonic acid, and ethylamino naphthalenesulfonic acid. Preferred alkyl aromatic sulfonic acids are selected from the group consisting of alkyl benzenesulfonic acid and alkyl toluenesulfonic acids.

Useful alkyl aromatic sulfonates include the sulfonates corresponding the above-listed sulfonic acids. Preferably, the sulfonates have a cation selected from the group consisting of sodium, potassium, calcium, lithium, magnesium, aluminum and mixtures thereof. In a particularly preferred embodiment, sodium dodecyl benzenesulfonate that is sold by the Pilot Chemical Company under the trade name Calsoft TM is used.

The alkyl aromatic sulfonic acid, alkyl aromatic sulfonic sulfonate, or mixture thereof, is present in an amount between about 10 to about 20% by weight, preferably about 13%, as opposed to the lesser 5 to 6% by weight amounts conventionally used in sodium stearate formulations. It is believed that when the alkyl aromatic sulfonic acid is present, it reacts with a strong base to produce, at least in part, some amount of the corresponding sulfonate, a semi-solid product which evidently contributes to the desirably firm but yielding physical quality of the composition.

The strong base present in the composition can be any strong base which is capable of reacting in situ with the alkyl aromatic sulfonic acid or the sulfonic acid corresponding to the alternative alkyl aromatic sulfonate to form a semi-solid sulfonate product. Useful strong bases include alkali metal hydroxides, such as sodium, potassium, calcium, ammonium, or lithium hydroxide; substituted and unsubstituted alkylamines, such as dimethyl amine, dimethyl pentyl amine, t-butyl amine, diethyl amine, diethyl methyl amine, diethanolamine, diisopropyl amine, 2,2-dichlorodiethyl methyl amine, 2,2-diethoxydiethyl methyl amine, ethyl methyl amine, triethanolamine, triethyl amine, diethyl amine and 2-bromotriethyl amine; and mixtures thereof.

The amount of strong base in the composition of the invention should be sufficient to raise the pH of the composition, prior to the addition of the sodium bicarbonate, to at least 9.2. This high pH is thought 2, 0 to be important in facilitating the reaction in situ of the base with the alkyl aromatic sulfonic acid (or the sulfonic acid corresponding to the alternative alkyl aromatic sulfonate) to form a semi-solid sulfonate product. Thus, the amount of strong base can vary between about 2 to about 6% by weight, but preferably is present at a concentration of about 3 to 5% and, most preferably, about 4% by weight.

Following the reaction of the strong base with the sulfonic acid to form a semi-solid product, sodium bicarbonate is added to reduce and maintain the pH at a lower range to enhance the activity of the enzymes, particularly over an extended period of time. This less caustic product is also less damaging to fabrics. As a result, the composition can be used on a wider variety of materials and can remain on the material for extended periods of time with less danger of significant damage to the fabric.

When sodium bicarbonate is added to achieve this reduction in pH, unexpectedly, the hardness is maintained above the 55 mm minimum level thought to be important for easy application of the composition to the fabric. Further, the drop point is simultaneously maintained above the 115° F. minimum that is important for shipping and warehousing the final composition.

Typically, the amount of sodium bicarbonate necessary to achieve this optimum balance of lower pH, hardness and drop point is between about 3 and about 6% by weight but, preferably, the sodium bicarbonate is present in the range of about 4 to 5% and, most preferably, about 5% by weight.

By encapsulating an additional portion of sodium bicarbonate for the solid laundry pre-spotter composition, the use and effectiveness of the composition may be enhanced. Specifically, this further addition of the encapsulated sodium bicarbonate furnishes the fabric with a concentrated amount of sodium bicarbonate directly onto the soil or stain, which is believed to be beneficial in the liberation of the soil or stain from the fabric.

Encapsulation of sodium bicarbonate may be accomplished in a variety of ways, such as through the use of porous polymeric particulate. Such a polymeric material may be used to entrap or encapsulate functional materials within a syneresis-free lattice network. Often, as much as about 50 to about 70% of the functional material may be so entrapped or encapsulated. The polymeric material, such as methacrylic ester copolymer, also provides modest abrasiveness to the soiled or stained area of the fabric. In addition, the polymeric material degrades under pressure to release a concentrated amount of sodium bicarbonate at the point of application on the soiled or stained fabric.

The composition of the invention preferably includes at least one nonionic surfactant in addition to any alkyl aromatic sulfonic acid or sulfonate that is present. It is believed that the nonionic surfactant assists in the removal of the soil after the soil has been at least partially degraded by the enzyme in the composition. The term nonionic surfactant includes all such surfactants as are commonly understood to be embraced in the laundry and dry cleaning arts. For example, the term includes ethoxylated and propoxylated straight-chain alcohols, such as Texaco L-46-7 TM (CTFA name, Surfonic L-46-7), Tergitol 15-5-3 TM (a product of Union Carbide Corporation having a carbon chain length of 15, a secondary alcohol, and the equivalent of 3 ethylene oxide units), and coconut fatty acid monoethanolamide; and phenylalcohols, particularly $C_4$–$C_2$ alkyl phenols such as Texaco NP-4 TM (CTFA name, Nonoxynol-4) which has the general formula:

$$C_9H_{19}\text{-}C_6H_4\text{-}(OCH_2CH_2)_nOH,$$

where n has an average value of 4, and nonyl phenol ethoxylate (9.0 moles ethylene oxide).

Further, a mixture of one or more of the above surfactants can be used. Especially preferred surfactants include ethoxylated straight-chain alcohols such as Texaco L-46-7 TM (CTFA name, Surfonic L-46-7), ethoxylated alkyl phenols such as Texaco NP-4 TM (CTFA name, Nonoxynol-4) and mixtures thereof.

The total concentration of these surfactants is not particularly critical and may vary widely depending on the hardness desired for the stearate matrix, as will be recognized by one skilled in the art. Preferred total amounts range from between about 20 and about 35% by weight, more preferably about 25 to 30% and, most preferably, about 26% by weight. In a particularly preferred embodiment, the nonionic surfactant comprises a mixture of about 10 to 15% by weight of an ethoxllated straight-chain alcohol and about 10–15% by weight of an ethoxylated alkyl phenol.

The enzymes used in the invention include such enzymes as are commonly known to those who work in the laundering and dry cleaning arts, such as proteases, lipases and amylases, which may be in a stabilized blend or may be in an unstabilized preparation with calcium salts added for stabilization. Proteolytic and amyolytic enzymes are preferred. Proteolytic enzymes, which alter protein-derived stains and soils, are particularly preferred since, once the proteins have been degraded, the surfactant is more likely to clean the remaining soils and stains.

Specific useful enzyme systems include an enzyme material supplied by Novo Nordisk Company Danbury, Connecticut, under the name Alcamyl TM, and an enzyme material also supplied by Novo Nordisk under the name Savinase TM. Alcamyl TM is a mixture of Novo Nordisk's Alcalase TM and Termamyl TM enzymes. Alcalase TM is a proteolytic enzyme; Termamyl TM is an amyolytic enzyme. Proteolytic enzymnes break down proteins to soluble components; amyolytic enzymes hydrolyze starches, rapidly breaking them down to soluble dextrins and oligosaccharides. Savinase TM is a proteolytic enzyme, specifically an endo-protease of the serine type. Savinase hydrolyzes the protein in the stains, forming peptides which are readily soluble during cleaning.

Preferably, the amount of the enzyme used in the composition of the invention is between about 2 and about 10% by weight and, more preferably, between about 3 and about 5% by weight.

The composition of the invention includes water in an amount higher than that typically encountered in stearate matrix-type products, i.e., preferably, from about 20 to about 30% by weight, more preferably, about 20 to about 25% by weight. Most preferably, the amount of water is about 23% by weight. Generally, the amount of water should be sufficient to contribute desirably to the yieldability of the stearate matrix.

The compositions may be further enhanced for use by consumers by adding small amounts of a fragrance, preferably a fruity, clean or sanitizing scent, most preferably a citrus-type scent. When a fragrance is used, the concentration will depend on the type and strength of scent produced by the particular additive used. However, typically, when a fragrance is present, it is used in an amount between about 0.05 and about 2% by weight, with a concentration of about 0.5 to about 1.5% by weight being preferred.

In pre-spotting and other laundry-type products, the final product is often translucent to opaque. Accordingly, a dye may be added so that the user can see where the composition has been applied. Further, traditional coloring agents can be added to provide a more desirable color or one that would be judged by the consumer as appropriate or more pleasing for a laundry product. Examples of useful coloring agents include titanium dioxide, pearlescent agents of the type customarily used in the cosmetic and soap industry, various organic dyes commonly used in laundry and detergent products, and other coloring and opacifying agents that would give color to the product, but which would not dye, discolor, or otherwise damage the fabric on which the composition is used.

When coloring agents are present, they are generally used in an amount between about 0.001% and about 0.005% by weight. Preferably, the coloring agent is an organic dye and is present in an amount of about 0.004% by weight of the total composition.

Detergent builders need not be added to the pre-spotter stick composition of the invention, since the sodium bicarbonate serves the additional function of a detergent builder. However, if desired, additional detergent builders may be added to the composition of the invention, including citric acid and its salts. When present, the additional builder is typically included in the composition in concentrations ranging from about 0.01 to about 10% by weight.

An antioxidant, such as sodium thiosulfate, may also be useful in the composition as a preservative. When present, the antioxidant is generally incorporated in an amount which is on the order of about 0.1% by weight.

The pH of the composition of the invention should be maintained in a range which is not so high as to preclude enzyme activity, but not so low as to produce a solid that is too soft and easily becomes mushy. For these reasons, the pH should preferably be between about 8.2 and about 9.0, even more preferably, between about 8.4 and about 8.8, and most preferably between about 8.5 and 8.6. (The pH is tested using a 1% solution in deionized water.)

The compositions of the invention are typically waxy, greasy, translucent to opaque solids. The temperature sensitivity of the novel composition can be measured in terms of the "drop point", i.e., the temperature at which actual drops of liquid are formed such that, if the generally solid composition were suspended above a surface, the drop formed would fall onto the surface due to the force of gravity. The drop point is usually tested by packing a small quantity of the composition into the closed end of a test tube, inverting the test tube in a container of water, gradually heating the water, and measuring the temperature at which the composition slides out of the test tube. Desirably, the drop point is greater than about 115° F. to maintain the dimensional stability of the composition during shipping and storage, but can be higher as the allowable hardness increases.

Hardness is generally measured in terms of an inverse relationship with "yield" or "penetrability", as determined with a penetrometer using an ASTM standard brass cone (with no additional weight added) and a penetration time of five seconds. The sample for the penetrometer determination is typically poured, while still molten, into a 2½-ounce cylindrical container, allowed to harden at room temperature, and then tested.

In preferred embodiments, the composition provides a relatively soft, but readily malleable material, which is a firm solid, but which is easily applied manually by the user directly to soiled portions of fabric which have been pre-selected for treatment prior to cleaning, preferably producing a glossy sheen on the soiled fabric. The penetrometer reading for stearate matrix consumer goods can vary widely, depending on consumer preferences, between about 30 to 300 units (3.0 to 30.0 mm), but preferably is about 50 to 90 units (5.0 to 9.0 mm). However, to meet the requirement for easy physical transferability upon abrasive contact with the fabric to which the composition is to be applied, the penetrometer reading for the composition should most preferably be at least about 55 units (5.5 mm).

The pH, drop point, and penetrometer reading are generally interrelated and interdependent. Thus, the "yield" value measured by the penetrometer cannot usually be changed without affecting one or both of the other two properties, that is, pH and drop point. If one selected a pH in the preferred range and an acceptable drop point for prior art pre-spotting sticks that are based on a stearate matrix carrier, the resulting compositions would be in a liquid state, or so soft as to be unsuitable for the convenience of stick application.

Thus, one of ordinary skill in the art would have expected that such pre-spotting sticks would not meet the criterion for sufficient "yield" or a penetrability of about 60 to 90 units. If one desired a product that was more active, for example, exhibiting a pH reading of 8.6, the hardness of a conventional i5 formulation would be in an unacceptable range, resulting in an unacceptable mushy, semi-liquid or liquid state. In addition, the drop point would be below the desired minimum drop point of about 115° F., which is desirable for stability in shipping and warehousing.

In contrast, the compositions of the invention exhibit an excellent balance of higher rigidity, strength and hardness, physical "yield" and transferability, acceptable resistance to the relatively high temperatures that may be encountered during shipping and storage, and a pH conducive to enzyme activity.

The composition of the invention may be prepared by combining most of the water, the propylene glycol and a minor portion of the strong base, preferably about 1.5% of the total composition weight, in a vessel with heating and agitation. The temperature at this point can vary widely, but should be high enough to facilitate dissolution of both of these ingredients while still being below the boiling point of the mixture. Suitable temperatures generally range from about 180 to about 192° F. and, most preferably, are about 190° F.

To this solution is added slowly (1) the sodium stearate with increased agitation and (2) then the polyethylene glycol. At each of these stages, it is preferable to continue heating and agitation, first until the sodium stearate has been completely dissolved to form a clear solution, and then until the polyethylene glycol is completely dissolved to form a clear solution. The time required for each of these steps can vary widely depending on the temperature, the agitation, and the relative amounts of the ingredients in the composition. Generally, however, the time for each step runs between 15 to about 45 minutes, most preferably from about 20 to about 30 minutes. The temperature may be increased somewhat within the above range to assure that both the sodium stearate and the polyethylene glycol are well dissolved, for example, from about 185° F. to about 190° F.

The warm solution is then cooled slightly, typically to a temperature from about 160 to about 180° F., most preferably about 170° F., and all surfactants are added, including the alkyl-substituted aromatic sulfonic acid, sulfonate, or mixture thereof. As the temperature gradually drops to room temperature, further additives, such as fragrance or coloring agents, are mixed in, and the pH is adjusted with the remaining portion of the strong base to a value within a range of from about 9.2 to about 9.6, preferably from about 9.2 to about 9.5. After sufficient additional agitation to assure complete mixing and reaction of the strong base with the sulfonic acid, and while still sufficiently warm to be liquid (about 130° F.), the sodium bicarbonate is added to the composition and mixed. The encapsulated sodium bicarbonate is then added to the composition with stirring. With continuing agitation, and while still warm enough to be pourable, the composition is cast into appropriate mold-like containers with the enzyme for forming applicator sticks, and then allowed to cool to room temperature to solidify. The enzyme is quickly mixed and then dispensed into the container in such a fashion that the enzyme remains substantially active at the final pH of the soft composition, as described in U.S. Pat. No. 5,046,538 issued on Sep. 10, 1991 to Allison et al., the disclosure of which is hereby incorporated by reference.

According to the process of the invention for cleaning fabric that has soiled or stained portions, the composition of the invention is applied to the soiled or stained portions of the fabric prior to cleaning and then the soiled or stained fabric to which the composition has been applied is laundered or dry cleaned. Thus, the stick applicator of the invention is used contactingly to apply the spot- and stain-removing composition of the invention to selected areas of soiled or stained fabric prior to subjecting the fabric to a cleaning operation.

According to this method, the composition can be applied to almost any type of fabric that can be either laundered in an aqueous detergent solution or dry cleaned in any one of a number of organic solvent-based cleaning compositions. Such fabrics include cotton, wool, rayon, silk, synthetics fibers such as nylon, polyester or polyester knit, and mixtures thereof, such as 65/35 Kodel TM /cotton or 65/35 Dacron TM /cotton.

The composition can be applied to one or more soiled or stained portions of the fabric at almost any convenient temperature, for example, at any temperature between the freezing point of water at 32° F. and the drop point temperature of the composition (at least 115° F.). Further, the temperature at which the composition can be applied will depend upon the fabric being treated and the type of laundering or dry cleaning process that will be used to clean the fabric. Preferably, however, the composition is applied to the fabric at a temperature between about 40 and 100° F. and, most preferably, is applied at about room temperature.

The composition may be applied with widely varying coverages. The amount of the composition applied should be sufficient to cover adequately heavily soiled or stained portions of the fabric. Thus, at the upper end of the scale, the amount is limited primarily by economic rather than technical considerations. Typically, the composition is applied for a coverage varying from about 0.08 to about 0.15 gram per square centimeter of fabric, with a coverage of about 0.10 gram per square centimeter being generally employed. The optimum coverage is that which results in a waxy sheen on the stain.

After application to the soiled or stained portion of the fabric, the composition is typically readily removed by laundering or dry cleaning the fabric with products customarily used in these arts. Preferably, the residue is removed by laundering with an aqueous solution that contains a combination of detergents, salts, surfactants and/or solvents at typical laundering temperatures.

As to dwell time, the fabric may be successfully cleaned within a time period of only a few minutes. No disadvantages are known to result from delaying the laundering step for a significant period of time, for example, for as long as about two weeks. In fact, an important practical advantage of the solid stick-type pre-spotting compositions is that they may be applied a number of days before subjecting the treated fabric to laundering with no adverse effects. In particular the use of encapsulated sodium bicarbonate in the compositions make such pre-spotting of a fabric a number of days before laundering may be advantageously performed.

On the other hand, no inconvenient dwell time or residence time is required after the composition has been applied to the soiled portion of the fabric. Thus, after the composition has been applied to the fabric, the fabric may be cleaned as soon as is convenient. The optimum time for application is any time between about one minute and two weeks before the cleaning operation.

The compositions of the invention are useful in effectively removing a broad spectrum of soils, including milk, blood, cocoa, and sugar, as well as grass stains. The compositions are also effective in facilitating the removal of grape juice stains, mustard spills, sebum, crayon, lipstick, and salad dressing.

However, the efficacy of the composition and method of use against other soils can be easily tested by applying a test preparation of the soil in question on a cotton swatch, applying the composition of the invention, and washing the swatch in 150 ppm hardness water at 100° F. in a Tergotometer beaker, with 100 cycles per minute of agitation and about 1.5 g/l of a non-phosphate powdered commercial detergent, such as Tide in hot water or Cold Power in cold water (both of which contain only about 8.7% phosphorus). Alternatively, test swatches can be graded for stain removal efficiency on a scale of "1" (complete stain removal) to "5" (no stain removal). Results are often reported as percent stain removal.

The following example serves to further illustrate, not to limit, the present invention.

EXAMPLES

Preparation of the Composition of the Invention

A composition of the present invention was prepared by heating 795 pounds of deionized water to 180° F. in a suitable stainless steel vessel equipped with turbine agitation and adding 300 pounds of propylene glycol. While reheating to 185° F., 45 pounds of NaOH (50%) were added under agitation. When the mixture reached 186° F., 360 pounds of sodium stearate C-1 were slowly added, and mixing was increased until the mixture was clear (approximately 35 minutes). With the mixture at 185° F., 140 pounds of polyethylene glycol (PEG 20000) TM were added. Mixing was continued for approximately 40 minutes until the mixture was again clear.

When the mixture had cooled to 170° F., 450 pounds of Surfonic TM NP-4 were added under continued mixing, followed by the addition of 450 pounds of Surfonic TM L-46-7 and then 450 pounds of CalSoft TM S-100, both under continued mixing. The mixture was permitted to cool to 135° F., whereupon 93 pounds of NaOH were added, increasing the pH from an initial reading of 7.4 to a final reading of 9.5. This was followed by the addition of 20 pounds of a fragrance, concluding with 10 minutes of mixing. The entire batch weight of 3,103 pounds was then permitted to cool to room temperature and stored in containers.

Sodium bicarbonate may be encapsulated by preloading it in a porous polymer particulate (such as the polymeric transport system commercially available from Dow Corning under the tradename Polytrap TM). This may be accomplished by dispersing sodium bicarbonate into a liquid in which it is not soluble. While many liquids are suitable in this regard, hydroxylated organic liquids are preferred, such as alcohols and polyols. One such liquid is propylene glycol. With any of the suitable liquids a sufficient amount should be used to achieve a concentrated, but fluid dispersion.

Thereafter about 70 parts of this sodium bicarbonate-propylene gycol dispersion may be added to about 30 parts of the polymeric material. Care should be taken so that agglomeration is avoided. In that regard, high shear mixing may be used to provide a uniform dispersion and active encapsulation in the porous polymer particulate. The degree of encapsulation may be determined using microscopy to examine the absence of free sodium bicarbonate.

At a later time, a 280 gram sample may be reheated to 130° F., and 10.4 grams of sodium bicarbonate and 10.4 grams of encapsulated sodium bicarbonate may be added with mixing. This resulting mixture may be poured into molding containers, with the addition of 10.4 grams of the enzyme Alcamyl TM.

The resulting product will have the following composition:

| COMPONENT | PERCENT BY WEIGHT |
|---|---|
| Deionized Water | 23.05% |
| Propylene Glycol | 8.70% |
| NaOH (50%) | 4.01% |
| Sodium Stearate C-1 | 10.43% |
| PEG 20,000 | 4.05% |
| Surfonic TM NP-4 | 13.05% |
| Surfonic TM L-46-7 | 13.05% |
| CalSoft TM S-100 | 13.05% |
| Fragrance | 0.57% |
| Alcamyl TM | 3.34% |
| Sodium Bicarbonate | 3.34% |
| Encapsulated Sodium Bicarbonate | *3.34% |

*with about 30% of this value attributable to the polymeric material.

Other embodiments of the invention will be apparent to those skilled in the art from consideration of the specification and practice of the invention disclosed herein. It is intended that the specification and examples be considered as exemplary, with the true scope and spirit of the invention being defined by the following claims.

What we claim is:

1. A soil and stain remover composition in applicator stick form for application to fabric as an aid in cleaning, said composition comprising:

a. from about 10 to about 15% by weight of sodium stearate;

b. from about 8 to about 11% by weight of propylene glycol;

c. from about 3 to about 6% by weight of a polyethylene glycol;

d. from about 10 to about 20% by weight of an alkyl aromatic sulfonic acid surfactant, an alkyl aromatic sulfonate surfactant that has been formed in situ by the reaction of said alkyl aromatic sulfonic with a strong base, or a mixture thereof;

e. from about 2 to about 6% by weight of a strong base capable of reacting in situ with said alkyl aromatic sulfonic acid surfactant to form a semi-solid sulfonate product;

f. from about 20 to about 35% by weight of at least one nonionic surfactant, wherein said nonionic surfactant is different from said alkyl aromatic sulfonic acid surfactant or said alkyl aromatic sulfonate surfactant above;

g. from about 2 to about 10% by weight of an enzyme;

h. from about 20 to about 30% by weight water;

i. an amount of sodium bicarbonate sufficient to reduce the pH of said composition to a range of about 8.2 to about 9.0; and j. an additional amount of sodium bicarbonate sufficient to enhance the soil and stain removing capabilities of said composition, wherein said sodium bicarbonate is in an encapsulated form, such that said sodium bicarbonate is released under the pressure of application to soiled or stained fabric, wherein the composition exhibits a drop point greater than about 115° F. and a penetrometer reading of at least about 55 units (5.5 mm), and wherein the encapsulated sodium bicarbonate directs the soil and stain removing capabilities of the composition to the point of application on the fabric.

2. The composition of claim 1, wherein the sodium stearate is present in the amount of about 11% by weight.

3. The composition of claim 1, wherein the propylene glycol is present in an amount of about 9% by weight.

4. The composition of claim 1, wherein the polyethylene glycol has a molecular weight of at least 3,000.

5. The composition of claim 1, wherein the polyethylene glycol is present in an amount of about 4% by weight.

6. The composition of claim 1, wherein:

a. any alkyl aromatic sulfonic acid surfactant present is selected from the group consisting of alkyl benzenesulfonic acids and alkyl toluenesulfonic acids and b. any alkyl aromatic sulfonate surfactant present is selected from the group consisting of alkyl benzenesulfonates and alkyl toluenesulfonates.

7. The composition of claim 1, wherein the total amount of the alkyl aromatic sulfonic acid surfactant and alkyl aromatic sulfonate surfactant present is about 13% by weight.

8. The composition of claim 1, wherein the strong base is an alkali metal hydroxide.

9. The composition of claim 1, wherein the strong base is sodium hydroxide.

10. The composition of claim 1, wherein the strong base is present in the amount of about 4% by weight.

11. The composition of claim 1, wherein the nonionic surfactant is selected from the group consisting of ethoxylated and propoxylated straight-chain alcohols and ethoxylated alkylphenols.

12. The composition of claim 1, wherein the nonionic surfactant is a mixture of an ethoxylated straight chain alcohol and an ethoxylated alkyl phenol.

13. The composition of claim 1, wherein the total amount of said nonionic surfactants present, except for any alkyl aromatic sulfonic acid or alkyl aromatic sulfonate surfactant, is about 25 to 30% by weight.

14. The composition of claim 1, wherein the enzyme comprises a member selected from the group consisting of proteolytic and amyolytic enzymes.

15. The composition of claim 1, wherein the enzyme comprises a proteolytic enzyme.

16. The composition of claim 1, wherein the enzyme is present in an amount of about 3 to about 5% by weight.

17. The composition of claim 1, further comprising a fragrance.

18. The composition of claim 1, further comprising a coloring agent.

19. The composition of claim 1, wherein water is present in an amount from about 20 to about 25% by weight.

20. The composition of claim 1, wherein the sodium bicarbonate of (i) is present in an amount of about 3 to about 6% by weight.

21. The composition of claim 1, wherein the pH is between about 8.4 and about 8.8.

22. The composition of claim 1, wherein the encapsulated sodium bicarbonate of (j) is entrapped in a polymeric network.

23. The composition of claim 22, wherein the encapsulated sodium bicarbonate contains at least about 50% by weight sodium bicarbonate.

24. The composition of claim 1, wherein the material used to encapsulate the additional amount of sodium bicarbonate provides abrasiveness to the soil or stain on the fabric when the composition is applied thereto so as to aid in liberating the soil or stain from the fabric.

25. A laundry soil and stain remover composition in applicator stick form for application to fabric as an aid in laundering, said composition comprising:

a. about 11% by weight of sodium stearate;

b. about 9% by weight of propylene glycol;

c. about 4% by weight of a polyethylene glycol;

d. about 13% by weight of an alkyl aromatic sulfonic acid surfactant, an alkyl aromatic sulfonate surfactant, or a mixture thereof;

e. about 4% by weight of a strong base capable of reacting in Situ with said alkyl aromatic sulfonic acid surfactant or the sulfonic acid corresponding to said alkyl aromatic sulfonate to form a semi-solid sulfonate product;

f. from about 25 to about 30% by weight of at least one nonionic surfactant, wherein said nonionic surfactant is different from said alkyl aromatic sulfonic acid surfactant or said alkyl aromatic sulfonate surfactant above;

g. from about 3 to about 5% by weight of an enzyme;

h. from about 20 to about 25% by weight water;

i. from about 3 to about 5% by weight sodium bicarbonate; and j. an additional amount of sodium bicarbonate in the range of about 3 to about 5% by weight, wherein said sodium bicarbonate is in an encapsulated form such that said sodium bicarbonate is released under the pressure of application to soiled or stained fabric, and wherein the encapsulated sodium bicarbonate contains an least about 50% by weight sodium bicarbonate, wherein the composition exhibits a drop point greater than about 115° F. and a penetrometer reading of at least about 55 units (5.5 mm), and wherein the encapsulated sodium bicarbonate directs the soil and stain removing capabilities of the composition to the point of application on the fabric.

26. The composition of claim 25, wherein:

a. said polyethylene glycol has a molecular weight of at least about 3,000;

b. said alkyl aromatic sulfonic acid surfactant is dodecyl benzenesulfonic acid and said alkyl aromatic sulfonate surfactant is sodium dodecyl benzenesulfonate;

c. said strong base is sodium hydroxide;

d. said nonionic surfactant comprises a mixture of about 10 to 15% by weight of an ethoxylated straight chain alcohol and about 10 to 15% by weight of an ethoxylated alkyl phenol;

e. said enzyme comprises a proteolytic or amyolytic enzyme; and f. said composition further comprises about 1% by weight of a fragrance.

27. The composition of claim 25, wherein the material used to encapsulate the additional amount of sodium bicarbonate provides abrasiveness to the soil or stain on the fabric when the composition is applied thereto so as to aid in liberating the soil or stain from the fabric.

* * * * *